United States Patent [19]

Wolf et al.

[11] Patent Number: 5,009,677

[45] Date of Patent: Apr. 23, 1991

[54] PROCESS FOR SEPARATING PARTICULATES IN AN ELECTROSTATIC PRECIPITATOR

[75] Inventors: Steven D. Wolf, Pocatello, Id.; James L. Manganaro, Princeton, N.J.; Ronald H. Miller, Pocatello, Id.

[73] Assignee: FMC Corporation, Philadelphia, Pa.

[21] Appl. No.: 546,958

[22] Filed: Jul. 2, 1990

Related U.S. Application Data

[62] Division of Ser. No. 401,904, Sep. 1, 1989, Pat. No. 4,968,330.

[51] Int. Cl.[5] ..... B03C 3/00

[52] U.S. Cl. ..... 55/12; 55/13; 55/96

[58] Field of Search ..... 55/12, 13, 96, 108, 55/112, 114, 128, 129, 133, 151

[56] References Cited

U.S. PATENT DOCUMENTS

| | | | |
|---|---|---|---|
| 1,333,790 | 3/1920 | Bradley | 55/129 |
| 1,444,997 | 2/1923 | Anderson | 55/112 |
| 2,596,526 | 5/1952 | Busfield | 55/128 |
| 2,608,266 | 8/1952 | Wintermute | 55/129 |
| 2,730,195 | 1/1956 | Roberts | 55/129 |
| 2,853,150 | 9/1958 | Lenehan | 55/128 |
| 2,884,087 | 4/1959 | Watts | 55/114 |
| 3,951,624 | 4/1976 | Snader | 55/128 |
| 4,026,683 | 5/1977 | Snader et al. | 55/133 |
| 4,181,509 | 1/1980 | Honacker et al. | 55/129 |

FOREIGN PATENT DOCUMENTS

| | | | |
|---|---|---|---|
| 511913 | 6/1952 | Belgium | 55/129 |
| 381631 | 10/1932 | United Kingdom | 55/129 |

*Primary Examiner*—Jay H. Woo
*Assistant Examiner*—C. Scott Bushey
*Attorney, Agent, or Firm*—Frank Ianno; Eugene G. Seems

[57] ABSTRACT

An improved electrostatic precipitator, and its process of operation is described which contains essentially vertical tubes acting as vertical collector electrodes with discharge wire electrodes suspended therein, wherein a novel nonfouling chain screen is employed as a distributor for the upward flowing gas stream and collected dust is dropped onto and passed downwardly through the chain screen for discharge.

2 Claims, 1 Drawing Sheet

PROCESS FOR SEPARATING PARTICULATES IN AN ELECTROSTATIC PRECIPITATOR

This application is a division of application Ser. No. 401,904, filed Sep. 1, 1989, now U.S. Pat. No. 4,968,330.

BACKGROUND OF THE INVENTION

1. Field of the Invention

The invention relates to the separation of fine particulates from gas streams by means of electrostatic precipitators, and more particularly to the baffle assemblies used as distributors for the particulate-laden gas streams fed into the precipitators. Electric precipitators are well known in the art for their ability to separate fine particulates present in gas streams. An example of an electrostatic precipitator of the plate type is illustrated in U.S. Pat. No. 4,026,683 issued to Earle S. Snader et al. on May 31, 1977.

2. Description of the Related Art Including Information Disclosed under 37 C.F.R. Paragraphs 1.97–1.99.

In these types of electrostatic precipitators, gas flows through a duct past a distributor plate, or baffle, and then proceeds in a substantially horizontal plane through the precipitator through broadly defined gas passages. In these gas passages, a plurality of discharge wire electrodes and collector electrodes are suspended within the precipitator and contact the dust laden gas stream as it proceeds through the precipitator. The discharge wire electrodes ionize the particles in the gas stream flowing past them and the ionized particles are then attracted to and deposited on the vertical surfaces of the collector electrodes.

The collector electrodes are in the form of flat plates vertically suspended and in proximity to, but always separate from, the discharge wire electrodes. The dust particles which cling to the vertical collector electrodes, are dislodged and fall when the collector electrodes are periodically rapped. The dust falls to the bottom of the precipitator where it is collected in hoppers suspended below the collector electrodes. An opening at the base of the hopper provides an outlet for periodic removal of the separated particulates.

Such electrostatic precipitators have come into wide use because of their ability to separate extremely fine particulates, as low as one micron, and even less than one micron, from the gas stream efficiently and quickly and without any excessive pressure drop in the gas stream being passed through the precipitator.

The plate-type electrostatic precipitator described above is appropriate for many applications; however, when the gas stream contains a high dust level, for example, as from electric furnaces producing phosphorus, the electrostatic precipitator that we would prefer to employ is a vertical tube electrostatic precipitator. This contains a plurality of vertically oriented tubes which act as the vertical collector electrodes. Within each of these tubes, a wire electrode is suspended along the center line which acts as the discharged electrode.

This configuration is preferred where high dust levels are found in the gas stream because the plurality of small tubes present uniform collecting surfaces and the electrical field is uniform within each of the tubes. That is, the distance between discharge wire electrodes and the internal surface of the tube which serves as the collecting electrode, is uniform throughout the length of the tube. Also, since this distance between the wire and tube electrodes is relatively small it permits more efficient collection of dust particles. The distribution of dust along the collecting electrode, namely, the interior surface of the collecting tube, is generally more uniform than in plate-type electrodes because of the uniformity of distance between the wire electrodes and the corresponding collecting electrodes.

In the treatment of dust-laden gas streams from an electric furnace used to produce elemental phosphorus, it has long been a problem that the electrostatic precipitators, whose function it is to remove dust from the elemental phosphorus and carbon monoxide gas stream exiting the electric furnace, have suffered from low collection efficiency. This is due principally to the poor gas distribution in the electrostatic precipitator. The gas enters on one side of the precipitator, sweeps to the opposite, and is thus unevenly distributed with the vast majority flow being on the far side of the gas inlet. Thus, the far side tubes suffer excessive gas velocities and consequently do not collect high amounts of dust, while the near side tubes see only a small flow and also, therefore, collect a small fraction of the dust. This poor dust collection performance is a major contributor to sludge production in the resulting condensed elemental phosphorus. The unremoved particles of dust combine with the elemental phosphorus to form a nonwettable globule that does not readily separate into phosphorus and water layers. This results in an intermediate sludge layer between the water and phosphorus layers that is relatively stable and which makes recovery of pure phosphorus difficult. Reduction of the amount of sludge produced is an important task facing the manufacture of elemental phosphorus by the electric furnace method. Thus, the design and operation of a more efficient electrostatic precipitator would directly impact on decreasing the significant sludge problem.

In operation, the particulate-containing gas stream is introduced into the electrostatic precipitator at its base and the gas stream is allowed to flow upwardly through the plurality of vertical tubes. The dust particles are ionized by the discharge wire electrodes suspended within the tubes and collect on the inside surfaces of the tubes which serve as the collecting electrode. Periodically, these tubes are rapped and the collected dust on the inside surfaces of the tubes is broken free and falls through the tubes into a hopper at the base of the electrostatic precipitator where a conveying screw removes it from the precipitator.

One of the problems in the operation of a vertical tube electrostatic precipitator is that the gas which is introduced at the base of the precipitator is difficult to distribute uniformly through the precipitator. This is because the gas inlet is usually at an angle of at least 9O° from vertical, and usually much more than 90°, when it enters the base of the electrostatic precipitator. This means that the gas must make at least a 90° turn before it begins its upward ascent through the tubes of the electrostatic precipitator.

In the absence of a distributor plate, the flow of the gas tends to accumulate on one side of the electrostatic precipitator, as described above, generally the side opposite the gas inlet. Once the gases enter predominately those tubes on one side of the precipitator they must continue to flow through the tubes entered. They can no longer be uniformly distributed throughout the precipitator, since, once entered, the tubes define the flow path throughout the entire precipitator.

The presence of a conventional distributor plate (a plate with multiple holes punched through it) would, of course, result in a more uniform distribution of gas into the base of the electrostatic precipitator; however, such a plate prevents proper removal of the collected dust which must of necessity pass through the distributor plate in order to fall downwardly into the hopper and be removed from the electrostatic precipitator. Also, use of such a distributor plate generally results in rapid fouling of the plate even after only a very short time of operation. For this reason, such distributor plates are not compatible with this kind of apparatus.

The present invention has for its objective a process and means for providing an electrostatic precipitator that obviates the problems aforesaid.

SUMMARY OF THE INVENTION

In accordance with the present invention, it has been found that an improved electrostatic precipitator, and its process of operation, provides for the cleaning of a particle-laden gas stream flowing through it, which precipitator, comprises in combination:

(a) shell means having a gas inlet means and a gas outlet means and defining a gas chamber therein, (b) a plurality of collector electrodes means in the form of substantially vertical hollow members, preferably cylinders, suspended within the shell means and defining passages therethrough, (c) a plurality of discharge electrode wire means suspended within the hollow members for ionizing particles in the gas for collection on the collector electrode means, (d) a hopper secured below the shell means for collecting particles discharged from the collector electrode means, (e) a gas distribution baffle means composed of a porous chain screen positioned transverse to the upward flow path of the particle-laden gas wherein each end of the chain segments that make up the chain screen are fixed to support members, and said chain screen has a porosity sufficient to permit the upwardly flowing particle-laden gas to penetrate the chain screen and provide a more uniform distribution of said particle-laden gas through the substantially vertical hollow members of the collector electrode means, and passing dust that is periodically discharged from the electrode collectors means downwardly through the chain screen into the hopper for discharge.

In effect, the chain screen acts as a distributor plate that allows the dust-laden gas stream to pass through it in an upwardly direction to properly distribute the gas flow throughout the electrostatic precipitator and simultaneously permits the collected precipitator dust to pass downwardly through the chain screen without fouling the curtain and preventing it from acting as a distributor plate for the upwardly flowing gas stream.

DESCRIPTION OF THE PREFERRED EMBODIMENT

Figure 1:
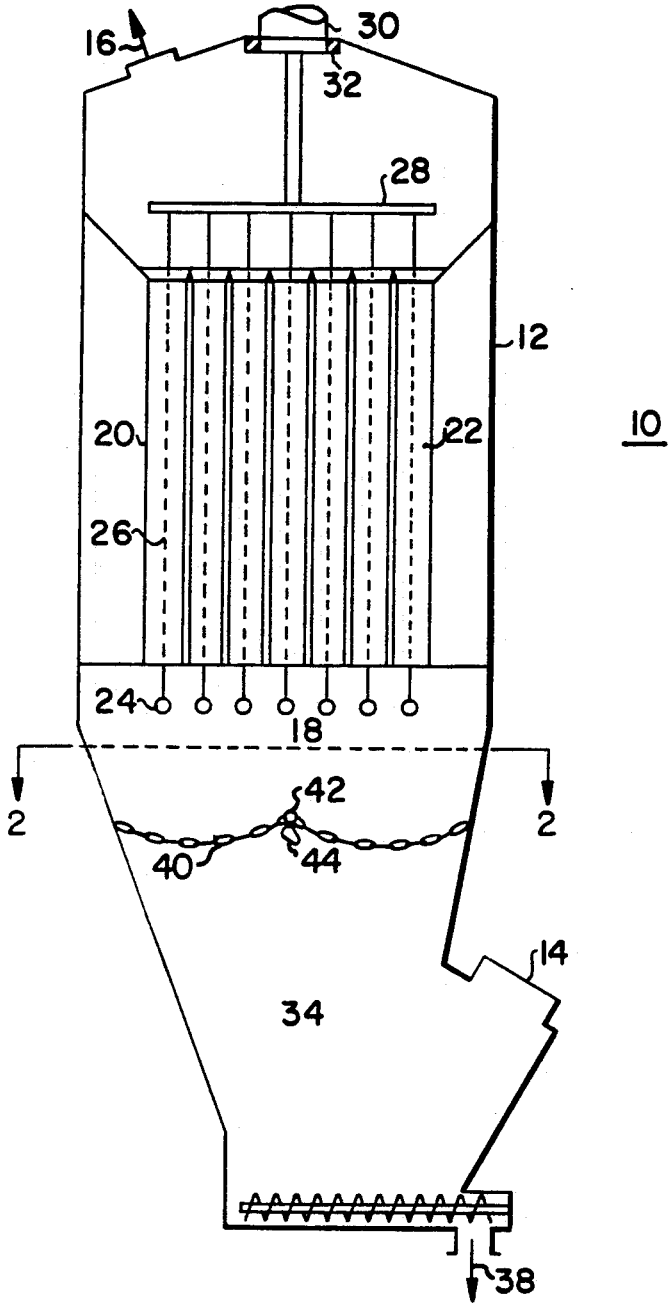
FIG. 1 is a schematic illustration inside of an electrostatic precipitator of the present invention.

The present invention comprises in combination a vertical tube electrostatic precipitator, a chain screen distributor or baffle below the precipitator, and a hopper located below the chain distributor for receiving and conveying dust from the system. The system is shown in FIG. 1 wherein there is illustrated schematically an electrostatic precipitator 10 which includes a shell 12, a chain baffle distributor 40 and a hopper 34. The shell 12 defines a gas chamber including a gas inlet 14 and a gas outlet 16. Within the shell 12 are substantially vertical, hollow members 20 which preferably are in the forms of cylinders or tubes defining gas passages 22 through the shell 12. These hollow members 20 serve as the collecting electrodes and are suspended within the shell 12 and electrically charged. A plurality of discharge electrode wires 26 are suspended from a supporting structure 28 and one such wire hangs along the center line of each of the collecting electrodes 20. Weights 24 on the end of each of the wires 20 maintain the wires taut. Wire guide assemblies (not shown) may be employed to prevent movement of the wires since contact between the discharge electrode wires 26 and the collecting electrodes 20 must be avoided. The support structure 28 is in turn connected to a discharge electrode lead 30 (also termed a "hot pole") to supply current to the wire electrodes. Insulators 32 prevent current from leaking between the hot pole 30 and the shell 12. Rapper assemblies (not shown) are used to periodically jolt the collecting electrodes 20 to dislodge dust which is collected on the inside surfaces of the tubes.

Figure 2:
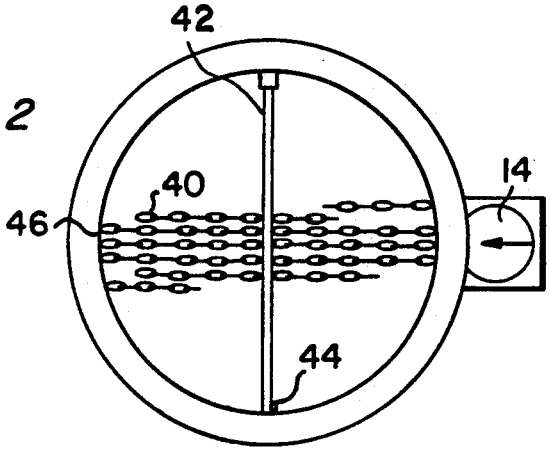
FIG. 2 is a schematic illustration of a precipitator taken along the lines marked as Section A in FIG. 1 looking downwardly on the chain screen which serves as a distributor or baffle in the present precipitator.

Situated below the collecting electrodes 20 and in a position transverse to the flow of any gas through the shell 12 of the electrostatic precipitator is a baffle or distributor 40. It is constructed in the form of a chain screen made up of individual lengths of chain each end of which are fixed to support members. This is shown in FIG. 2 in which the individual chains of screen 40 are attached to the fixed support members 46 and to a chain support member 42 which is a bar that is vertically moveable. Below the chain support 42 is a cam 44 which functions as a rapper by lifting the chain support and then allowing it to fall at periodic, predetermined times. The size of the links in the chains, the gauge of the metal in the links, and the spacing of the chain segments from one another across the width of the plenum section 18 of the electrostatic precipitator 10 are selected to provide the desired gas flow through the electrostatic precipitator 10. The distributor 40 permits a more uniform distributor of the gases in plenum 18 so that the up flowing gas stream is uniformly distributed through each of the tubes 20 in its path through the electrostatic precipitator 10.

Dust which collects in the collecting electrodes 20 is dislodged by rappers that jolt the collecting electrodes 20. The dust falls through, to the bottom of the collecting electrodes 20, and then falls onto the chain distributor 40. The chain screen that makes up the distributor 40 is periodically rapped by having chain rapper 44 lift the chain support member 42 and then dropping it to effect the rapping and movement of the chain distributor 40. This rapping allows the individual chains to hit against each other and also to vertically bounce which permits the dust that has accumulated on the distributor 40 to pass through the chain screen and into hopper 34 where it is conveyed by conveying screw 36 to the dust exit 38.

In accordance with the present process for using the electrostatic precipitator described above, a gas containing particulates enters the gas inlet 14 of the electrostatic precipitator 10. One typical gas stream that has been found ideal for treatment by the present process and equipment is the gas stream obtained from an electric furnace used to produce elemental phosphorus. In one such process, typical phosphatic shales found in the Western section of the U.S. containing about 23% to 27% $P_2O_5$ can be used for the production of phosphorus by heating it with a carbonaceous reducing agent, preferably, in an electric furnace. In one typical furnace, the ore is introduced along with coke particles into the furnace and heated until phosphorus vapor is evolved. The coke serves both as a reactant in the phosphate-reducing action and for conducting electricity through the bed. Heating is carried out by passing an electric current through the coke-containing feed mixture by means of conductive electrodes. The ore is heated until a molten bed composed principally of slag, that is, calcium silicate and ferrophos, is formed and all of the phosphate values have been recovered. The phosphorus and carbon monoxide products from the reaction are recovered overhead in gaseous form along with large amounts of unreacted coke and phosphate fines.

The gas stream that enters gas inlet 14 is laden with dust, and if derived from an electric furnace, also is at a high temperature, up to 700° C. The gas upon entering the base of the electrostatic precipitator 10 then makes a sharp turn of at least 90° and strikes the chain distributor 40 where the flow path of the dust-laden gas is more uniformly distributed in plenum 18.

The uniformly distributed dust-laden gas then enters the collecting electrodes 20 and passes through the gas passages 22 of the electrostatic precipitator. As the dust and gas rise through the collecting electrodes 20 the dust particles are ionized by means of the discharge electrode wires 26. The charged dust particles then collect on the inside of the collecting electrodes 20 while the gas stream, essentially free of dust particles is removed from the gas outlet 16.

The collecting electrodes 20 and the discharge electrode wires 26 are periodically rapped by means not shown to remove accumulated dust particles. The major portion of the dust which clings to the inside of the charged collecting electrodes 20, upon being dislodged by the rappers, falls through the tubes onto the chain baffle 40. The agglomerated dust particles that fall onto the chain baffle 40 are sufficiently massive that the up-flowing gases do not carry them back into the tubes. Instead, the agglomerated dust particles tend to momentarily block the gas stream from penetrating the chain baffle 40 at the points where the particle masses reside. However, on rapping the chain baffle 40 the particle masses fall through the chains and allow proper distribution of the gases to resume throughout the entire chain baffle 40.

The rapping of the collecting electrodes 20 takes place only periodically and the resulting dust masses are quickly removed so that prolonged interference with proper gas distribution does not occur. Note that when the temperature of the inlet gas stream is elevated, such as when treating gas streams from electric phosphorus furnaces, the high temperature of the gas stream and the dust particles, that is, up to 700° C., can result in fusion of the dust particles. Normally, discharge of these fused particles when they contact a distributor is very difficult to achieve. However, with the present chain baffle 40 the periodic rapping of the chain screen and the rapping of the chain segments against each other break up the fused pieces of dust and allow the dust to penetrate through the chain baffle 40 into the hopper 34 where the collected dust is conveyed by screw conveyor 36 and removed from the dust exit 38.

The required porosity of chain baffle 40 will depend on the rate of flow of the gas stream through the electrostatic precipitator and dust loading of the gas stream. The chain screen can be readily fabricated to allow the desired porosity by altering the gauge of the wire used to make up the links of the chains, the length of the links in the chain and finally the allowed space between the chain segments. In normal operation of the present electrostatic precipitator with phosphorus gases from an electric furnace it has been found that the pressure drop resulting from the chain baffle 40 is extremely low, no higher than 1.5 inches of water and 0.5 inches of water being typical, as compared with an electrostatic precipitator which does not contain any distributor or baffle.

In the above description of the operation of the electrostatic precipitator, the discussion has centered about the collection of dust on the top of the chain baffle 40 and the removal of this dust by passing it through the chain into the hopper 34. However, it is to be understood that some of the dust particles in the gas stream upon hitting the chain baffle 40 will also collect on the underside of the chain baffle 40. These dust particles will also be dislodged, upon rapping of the chain baffle, along with the particles on the upper portion of the chain that have fallen from the collecting electrodes 20. In this way, the chain baffle or distributor 40 remains essentially free of dust particles which have collected on the chains either as a result of dust agglomerates falling onto the chain or as a result of dust particles being collected on the underside of the chains as the gas stream flows upwardly through the chain screen 40.

As a result of this design, the chain baffle or distributor of the present electrostatic precipitator achieves simultaneously some very desirable and heretofore unobtainable results:

(1) it permits proper distribution of the dust-laden gas stream through the electrostatic precipitator;

(2) it allows particulates collected in the electrostatic precipitator to fall downwardly on the baffle and to pass through it without fouling;

(3) it results in a nonfouling distributor or baffle 40 which does not plug up as a result of particles collecting on the underside of the chains and as the result of agglomerated or fused dust particles falling onto the chains from the collecting electrode tubes; and (4) it achieves the above results with an extremely low pressure drop across the baffle or distributor 40.

EXAMPLE

A chain baffle of 50% porosity positioned in an electrostatic precipitator with the configuration shown in FIGS. 1 and 2 was placed in operation for a two-month period of time. During this time, a pressure drop increase of no more than 1.5 inches of water column was observed. The rate of dust collection in the hopper increased by 150% at a pressure drop of 0.5 to 0.75 inches of water column compared with the use of no baffle at the same rate of gas flow from an electric phosphorus furnace in both cases. Sludge production in the condensed phosphorus was found to be measurably reduced indicating less carry over of dust in the condensed phosphorus. The chain baffle operated without fouling from the collected dust and fused dust recovered from the electrostatic separator.

We claim:

1. A process for cleaning particle-laden gas flowing through an electrostatic precipitator zone comprising:

(a) passing a particle-laden gas into the inlet of an electrostatic precipitator zone having a gas inlet and gas outlet, (b) passing said gas upwardly through a low pressure drop gas distributor in the form of a nonfouling chain screen wherein individual movable chain segments whose ends are affixed to support members make up said chain screen, and more evenly distributing said gas flow throughout said electrostatic precipitator zone, (c) passing said gas into a plurality of collector electrode zones made up of substantially vertical hollow members suspended within said electrostatic precipitator zone, (d) passing said gas through said collector electrode zones in proximity to a plurality of discharge electrode wires suspended within said collector electrode zones, (e) ionizing said dust particles in said gas by means of said discharge electrode wires, (f) collecting ionized dust particles on the inside surfaces of said collector electrode zones, (g) removing collected dust particles from the inside surfaces of said collector electrode zones and dropping them onto and passing them through the movable segments of said chain screen gas distributor concurrent to said upward flowing gas, and into a hopper zone, and (h) removing gas, substantially reduced in dust, from said perpendicular zone through said gas outlet.

2. Process of claim 1, wherein said particle-laden gas is from an electric furnace for producing phosphorus, at elevated temperatures up to 700° C., and contains elemental phosphorus and carbon monoxide in gaseous form.

* * * * *

UNITED STATES PATENT AND TRADEMARK OFFICE

CERTIFICATE OF CORRECTION

PATENT NO. : 5,009,677

DATED : April 23, 1991

INVENTOR(S) : Steven D. Wolf, James L. Manganaro and Ronald H. Miller

It is certified that error appears in the above-identified patent and that said Letters Patent is hereby corrected as shown below:

Column 8, line 11, "concurrent" should read --countercurrent--; line 14, "perpendicular" should read --precipitator--.

Signed and Sealed this

Eleventh Day of August, 1992

*Attest:*

DOUGLAS B. COMER

*Attesting Officer*

*Acting Commissioner of Patents and Trademarks*